US005463881A

United States Patent [19]

Igarashi et al.

[11] Patent Number: 5,463,881

[45] Date of Patent: Nov. 7, 1995

[54] DOUBLE-KNIT FABRIC HAVING NON-RUN AND STRETCHABILITY CHARACTERISTICS AND METHOD AND APPARATUS FOR KNITTING THE SAME

[75] Inventors: Yoshiaki Igarashi; Yoshiro Ito, both of Hyogo, Japan

[73] Assignee: Precision Fukuhara Works, Ltd., Japan

[21] Appl. No.: 181,343

[22] Filed: Jan. 14, 1994

[30] Foreign Application Priority Data

Jan. 21, 1993 [JP] Japan ..... 5-027469

[51] Int. Cl.[6] ..... D04B 1/06; D04B 9/08

[52] U.S. Cl. ..... 66/31; 66/196; 66/197

[58] Field of Search ..... 66/194, 195, 196, 66/197, 198, 97, 169 R

[56] References Cited

U.S. PATENT DOCUMENTS 2,379,649 9/1937 Nebel ..... 66/97 X 4,019,350 4/1977 Schmidt ..... 66/196

FOREIGN PATENT DOCUMENTS 186767 10/1956 Germany ..... 66/198

0065157 4/1985 Japan ..... 66/196

1305212 4/1987 U.S.S.R. ..... 66/196

*Primary Examiner*—John J. Calvert

*Attorney, Agent, or Firm*—Bell, Seltzer, Park & Gibson

[57] ABSTRACT

A double-knit fabric having non-run and stretchability characteristics and method and apparatus for knitting the same in which multiple yarns are knit into cylinder needle and dial needle wales, in which two yarns are knit together into stitch loops in each wale, the stitch loops in adjacent wales in each course being knit of one yarn from the stitch loop in the adjacent wale in the same course and a yarn from a stitch loop in the adjacent wale from an adjacent course.

13 Claims, 7 Drawing Sheets

THE UPPER END OF THE FABRIC. THIS IS WHERE A RUN OCCURS. AFTER CUTTING, REMOVE RAVELINGS AND DISENTANGLE SO THAT LOOPS ARE ARRANGED ON THE END. THEN CUT OFF AT 7.5 cm IN THE WALE DIRECTION.

DOUBLE-KNIT FABRIC HAVING NON-RUN AND STRETCHABILITY CHARACTERISTICS AND METHOD AND APPARATUS FOR KNITTING THE SAME

FIELD OF THE INVENTION

The present invention relates to double-knit fabrics and more particularly to such fabrics, and a method and apparatus for knitting the same, having excellent non-run and stretchable characteristics.

BACKGROUND OF THE INVENTION

A variety of double-knit fabrics have been well known for many years. Such known double-knit fabrics provide many advantages over single-knit fabrics. However, these prior double-knit fabrics have certain deficiencies and disadvantages.

Foremost among such deficiencies and disadvantages is a tendency to generate knitting flaws, such as yarn breakage or off-positioned stitches, resulting in undesirable runs or second quality knit fabric. Another deficiency or disadvantage of conventional double-knit fabrics is limited stretchability, particularly in the course direction.

With the foregoing in mind, it is an object of the present invention to provide a double-knit fabric with excellent non-run and stretchability characteristics and method and apparatus for knitting the same.

SUMMARY OF THE INVENTION

The object of this invention is accomplished by a double-knit fabric, and method and apparatus for knitting the same, in which yarns are knit into successive wales and courses of stitch loops. Alternate wales are formed by cylinder needles and intervening wales are formed by dial needles. Each stitch loop is formed of first and second yarns in both the cylinder needle and dial needle wales. The stitch loops in the cylinder needle wales and the stitch loops in the dial needle wales are off-set from each other in the wale direction by a distance of one-half course.

One of the first and second yarns forming each stitch loop in the cylinder needle wales extends downwardly and becomes part of the adjacent lower stitch loop in the adjacent dial needle wale. The other of the first and second yarns forming each stitch loop in the cylinder needle wales extends upwardly and becomes part of the adjacent upper stitch loop in the adjacent dial needle wale.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE ILLUSTRATED EMBODIMENTS

Figure 2:
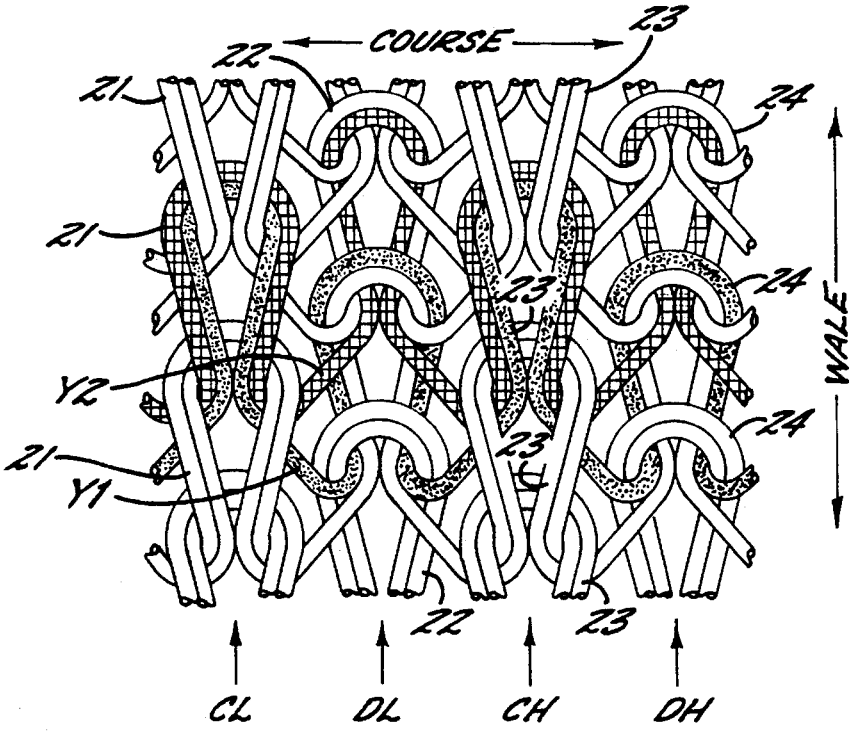
FIG. 2 is a fragmentary view of a double-knit fabric of the present invention.

Referring now more specifically to the drawings and particularly to FIG. 2, there is illustrated a double-knit fabric, generally indicated at 20, which incorporates the features of the present invention. Fabric 20 is knitted on an interlock circular knitting machine (not shown) having cylinder needles 42 (FIGS. 3–6) arranged alternately on a cylinder 40 and controlled in at least two ways by a cylinder needle selecting means. The knitting machine also includes dial needles 52 arranged alternately on a dial 50 and controlled in at least two ways by a dial needle selecting means.

Fabric 20 is knitted to include a series of stitch loops arranged in side-by-side wales extending length-wise of the fabric and courses extending around or width-wise of the fabric 20. In FIG. 2, there is illustrated a segment of the fabric 20 consisting of four wales CL, DL, CH and DH, including respectively stitch loops 21, formed by a cylinder needle (not shown) in wale CL, stitch loops 22 formed by a dial needle (not shown) in wale DL, stitch loops 23 formed by a cylinder needle 42 in wale CH and stitch loops 24 formed by a dial needle 52 in wale DH. The courses of fabric 20 have the cylinder needle stitch loops 21, 23 and the dial needle stitch loops 22, 24 off-set from each other with the cylinder needle stitch loops 21, 23 being one-half course higher than the dial needle stitch loops 22, 24.

The cylinder needle stitch loops 21, 23 and dial needle stitch loops 22, 24 are each formed of two yarns y1 and y2. Referring to FIG. 2, the cylinder needle stitch loops 21, 23 have both of the yarns y1 and y2 in the loops 21, 23 in that course. However, the dial needle stitch loops 22, 24 have the yarn y1 therein from that course, but have the yarn y2 therein from the adjacent lower course. In succession, the cylinder needle forms stitch loop 21 of both yarns y1 and y2. Yarn y1 extends coursewise in that same course, but downwardly to stitch loop 22 formed by dial needle which is holding thereon a stitch loop of yarn y2 from the preceding course, which is the adjacent lower course in fabric 20. Yarn y2 from stitch loop 21 extends coursewise but upwardly to the stitch loop 22 in the next succeeding or higher course in the dial needle wale DL. Yarns y1 and y2 are then both extended coursewise to cylinder needle 42 and form the stitch loop 23 in the same course as the original stitch loop 21 in wale CL. From stitch loop 23, yarns y1 and y2 extend coursewise to dial needle wale DH and form stitch loop 24 in the same manner as described above with respect to stitch loops 22.

Fabric 20 as illustrated in FIG. 2 is a rib-gated fabric as is easily recognizable from the shape of the stitch loops 21–24, inclusive. However, an interlock-gated fabric is also within the purview of the present invention.

Figure 7:
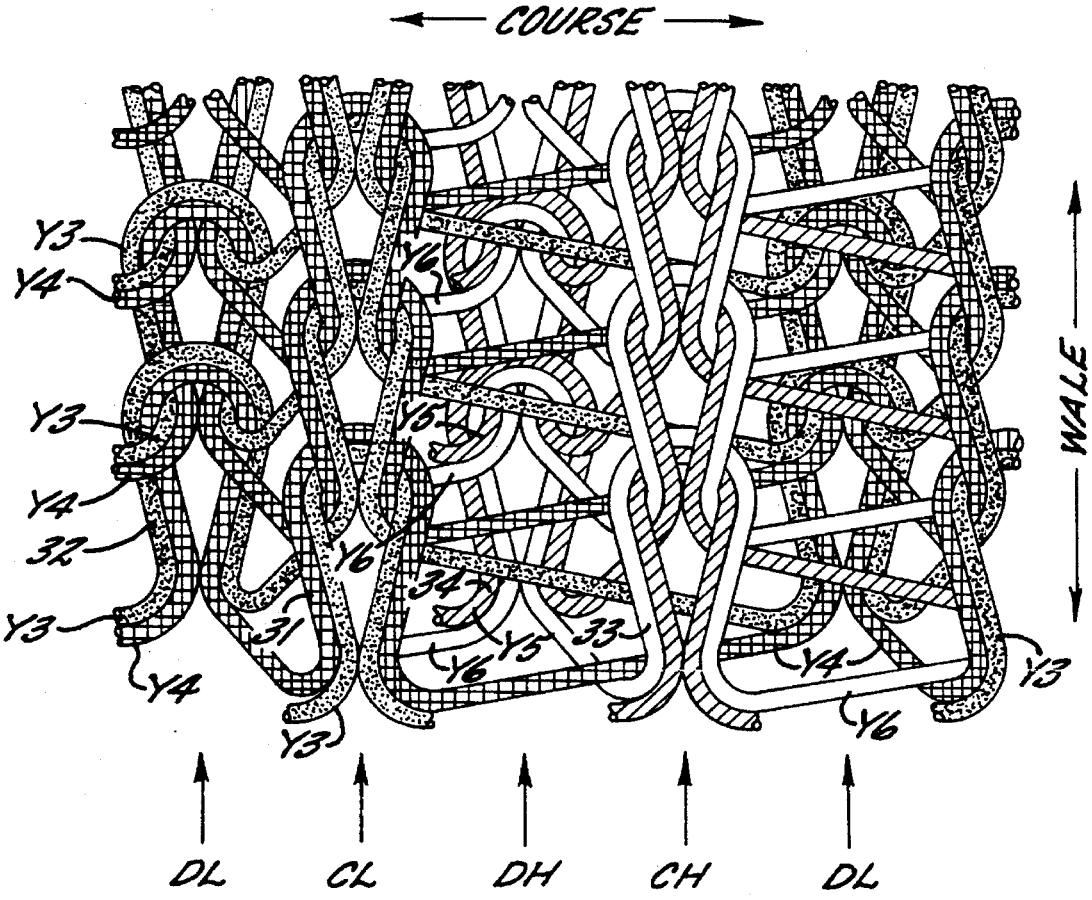
FIG. 7 is a view similar to FIG. 2 of another embodiment of the double-knit fabric of the present invention.

Referring now to FIG. 7, there is illustrated another embodiment of the present invention comprising a double-knit fabric 30. Fabric 30 is knitted by a rib-gating interlock circular knitting machine (not shown). However, an interlock-gating circular knitting machine could be used.

Fabric 30 includes wales CL and CH of cylinder needle stitch loops 31, 33 and wales DL and DH of dial needle stitch loops 32, 34. Each of the stitch loops 31–34, inclusive, is formed of two yarns. However, unlike fabric 20, the same two yarns are not knit in every wale.

The stitch loops 31, 32 formed by the cylinder needles (not shown) and dial needles (not shown) are formed of yarns y3 and y4 and the stitch loops 33, 34 formed by the cylinder needles 42 and dial needles 52 are formed of yarns y5 and y6. In the fabric 30, the dial needle stitch loops 32, 34 are off-set one-half course higher than the cylinder needle stitch loops 31, 33 in each course.

As illustrated in FIG. 7, yarns y3 and y4 are formed into dial needle stitch loops 32 and then yarn y4 extends coursewise to the cylinder needle wale CL and is formed into stitch loop 31 in the same course with a yarn y3 from the adjacent lower or preceding course. Yarn y3 from stitch loop 32 extends from stitch loop 23 coursewise to the cylinder needle wale CL and upwardly to the stitch loop 31 in the adjacent higher or succeeding course. From stitch loops yarns y3 and y4 extend coursewise across the wales DH and CH, without being knit therein, to the next dial needle wale DL where the same are knit together to form a stitch loop 32. Preferably, yarns y3 and y4 pass in front of dial needle stitch loops 34 in wale DL and behind cylinder needle stitch loops 33 in wale CL such that yarns y3 and y4 are internally of the fabric 30 rather than forming floats on the surface thereof.

Stitch loops 33 and 34 in wales CH and DH are formed of yarns y5 and y6 in the same manner as stitch loops 31 and 32 are formed of yarns y3 and y4. Accordingly, yarns y3 and y4 are knit only on cylinder needles (not shown) and dial needles (not shown) while yarns y5 and y6 are knit only on cylinder needle 42 and dial needle 52.

As stated previously, the interlock circular knitting machine of the present invention has a pair of needle beds, one being a cylinder 40 and the other being a dial 50 (FIGS. 3–6). The cylinder 40 includes two types of cylinder needles, only one of which is shown and designated 42, with needles (not shown) being of the low-butt type and needles 42 being of the high butt type. The glider needles are arranged alternately in vertical grooves in the cylinder 40 and are controlled in at least two ways by needle selecting means. The dial 50 includes two types of dial needles, only one of which is shown and designated 52, with the needles (not shown) being of the low-butt type and needles 52 being of the high-butt type. The dial needles are arranged alternately in radial grooves in the dial 50 and are controlled in at least two ways by needle selecting means.

Figure 1:
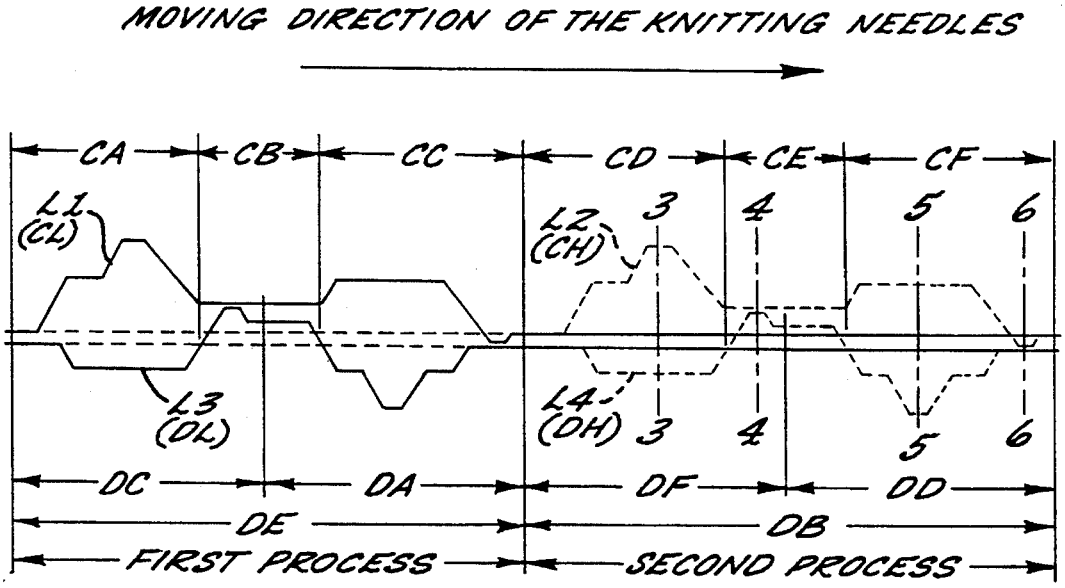
FIG. 1 is a schematic view of the knitting processes of the present invention.

As illustrated in FIG. 1, the interlock circular knitting machine has the following needle operating sections which comprise a first process and a second process: (a) high-tucking sections CA, CD, DA and DD; (b) holding sections CB, CE, DB and DE; and (c) clearing sections CC, CF, DC and DF. The high-tucking sections CA, CD, DA and DD each include a clearing section that clears the old loop from the latch of the knitting needle, a yarn feeding means that supplies at least one yarn, and a needle selecting means that moves the supplied yarn to the next section while holding it inside the hook without letting it form a loop.

The holding sections CB, CE, DB and DE each include means for causing the needle selected at the high-tucking section to move the old loop without knocking it over the head of the needle. The clearing sections CC, CF, DC and DF each include a yarn feeding means that supplies at least one yarn into the hook of the needle that is selected at the high-tucking section and a needle selecting means that causes the needle selected at the high-tucking section to form a stitch loop from the yarns supplied at the high-tucking section and at the clearing section and thereby knocking-over the old loop from the head of the knitting needle.

The needle selecting means (not shown) are preferably needle controlling cams having cam races that work together with the high and low butts on the needles 41, 42 and 51, 52. The yarn feeding means are preferably yarn carriers that feed yarns at a plurality of yarn feeding openings around the cylinder.

FIG. 1 illustrates a performance chart of the cylinder needles 41, 42 and the dial needles 51, 52 of the present invention. Performance line L1 represents the vertical and horizontal movement of the low-butt cylinder needles 41, while performance line L2 similarly represents the movement of the high-butt cylinder needles 42. Performance line L3 represents the movement of the low-butt dial needles 51 and line L4 represents the movement of the high-butt dial needles 52.

In the first process, the cylinder needles 41 are selected to be in the high-tucking position CA, the holding position CB and the clearing position CC and the cylinder needles 42 are held in the welt position. Similarly, the dial needles 51 are selected to be in the clearing position DC and the high-tucking position DA in the first process and the dial needles 52 are maintained in the holding position DE.

In the second process, the cylinder needles 42 move from the welt position which they occupied in the first process to the high-tucking position CD, the holding position CE and the clearing position CF and the cylinder needles 41 are maintained in the welt position DB. Similarly, the dial needles 52 which were maintained in the holding position DE in the first process are selected for the clearing position DF and the high-tucking position DD in the second process. The dial needles 51 are maintained in the holding position DB in the second process.

If either of the first or second process is performed, the fabric 20 will result. If both the first and second processes are performed, the fabric 30 will be obtained.

Figure 3:
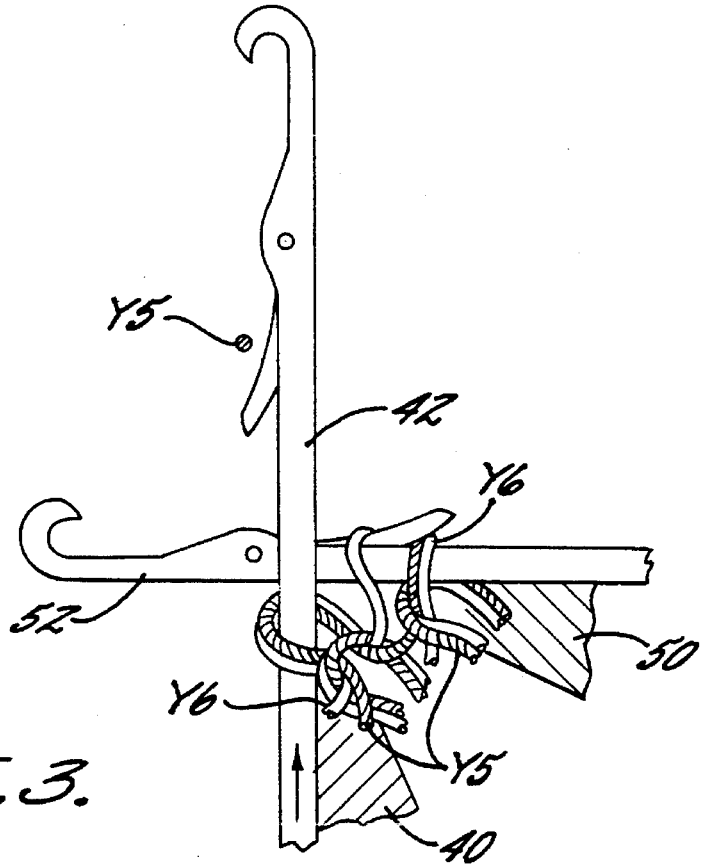
FIG. 3 is an enlarged fragmentary sectional view taken substantially along line 3—3 in FIG. 1.

The knitting method will now be described with reference to FIGS. 3–6, which illustrate the second process of FIG. 1, but which also applies to the first process. FIG. 3 illustrates the cylinder needle 42 at the highest level of the high-tucking position and the dial needle 52 in the intermediate position of the clearing position (section line 3—3 in FIG. 1). On cylinder needle 42, the old loop is cleared from the latch and a new yarn y5 is supplied to the hook of needle 42 by a yarn carrier (not shown). The old loop (consisting of yarns y5 and y6) has cleared the latch of the dial needle 52 and a new yarn y6 is held in the open latch. As the cylinder needle 42 descends, the new yarn y5 is caught in the hook of dial needle 52 and joins the held yarn y6.

Figure 4:
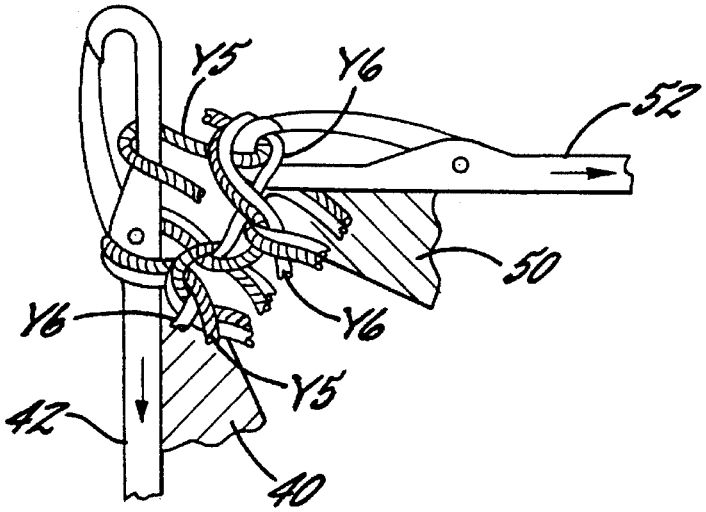
FIG. 4 is a sectional view similar to FIG. 3 taken substantially along 4—4 in FIG. 1.

FIG. 4 illustrates the position of the needles 42, 52 corresponding to section line 4—4 in FIG. 1. In reaching this position, the cylinder needle 42 has descended closing the latch and capturing the new yarn y5, but does not knock-over the old loop which remains on the shank of the cylinder needle 42. The dial needle 52 withdraws to the fully retracted position while closing the latch thereof and capturing both the new yarn y5 and the held yarn y6 in the hook and knocking-over the old loop from the end of the needle

52.

Figure 5:
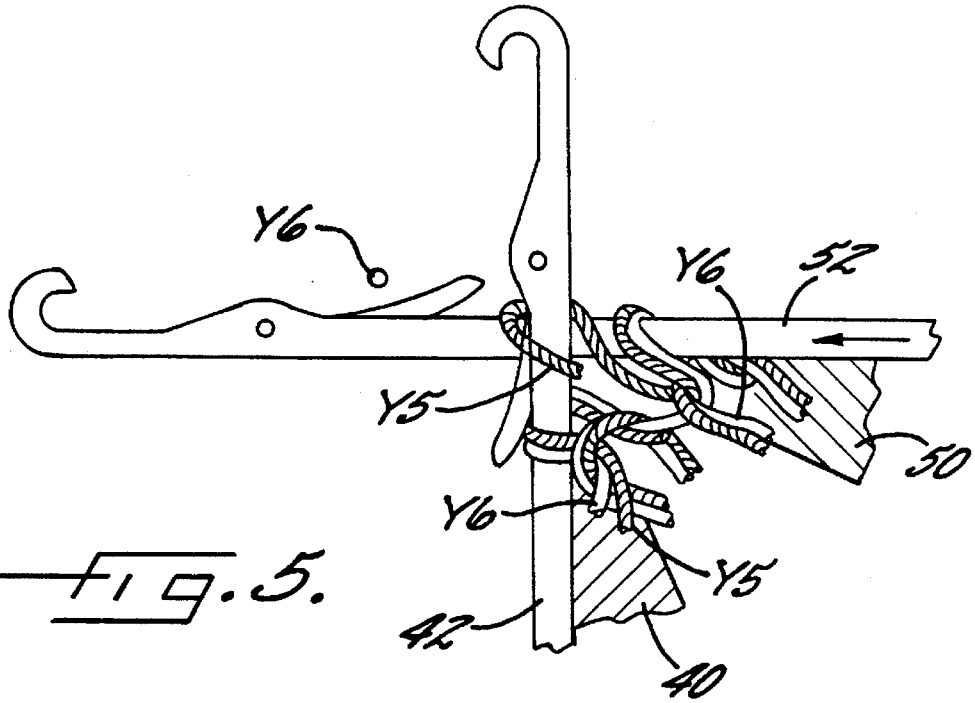
FIG. 5 is a sectional view similar to FIGS. 3 and 4 taken substantially along line 5—5 in FIG. 1.
Figure 6:
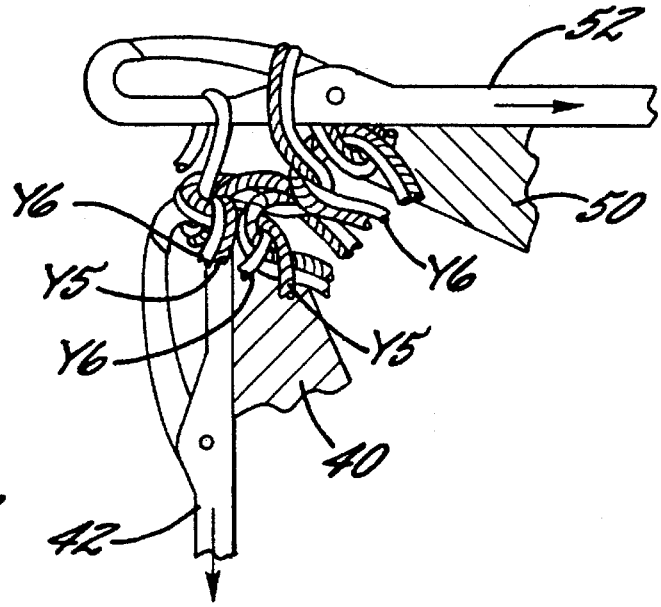
FIG. 6 is a sectional view similar to FIGS. 3–5 taken substantially along line 6—6 in FIG. 1.

In FIG. 5, which corresponds to section line 5—5 in FIG. 1, the cylinder needle 42 is in the intermediate position with the latch thereof open, but with the yarn y5 not cleared from the latch. A new yarn y6 is supplied by a yarn carrier (not shown) to the dial needle 52 which is in the fully extended position of the high-tucking position and the old loop is cleared from the latch thereof.

Thereafter, the dial needle 52 withdraws and brings the new yarn y6 to the cylinder needle 42 which captures the new yarn y6 in the hook thereof as needle 42 descends with the held yarn y5 already in the hook thereof. As the dial needle 52 withdraws, the old loop closes the latch thereof (FIG. 6) capturing the new yarn y6 in the hook, but the old loop is not knocked-over the end of the needle 52. The cylinder needle 42 does knock-over the old loop from the head thereof while the new yarn y6 and the held yarn y5 remain inside the hook.

The first and/or second processes are repeated for the cylinder needles 41, 42 and dial needles 51, 52 as the cylinder 40 and dial 50 rotate. Either fabric 20 or fabric 30 will be formed. Both fabric 20 and fabric 30 have double-structured stitch loops which provide excellent non-runability.

According to stretchability tests conducted, both fabrics 20 and 30 of the present invention can be stretched in the wale direction about the same amount as conventional interlocked fabric. However, the fabrics of this invention have considerably more stretch, about 27.3% more, in the course direction than such conventional double-knit fabrics. Therefore, the fabrics of this invention have excellent stretchability in the course direction. Additionally, the fabrics of this invention have soft surfaces and sufficient thickness to provide good warmth retaining properties.

For purposes of the run-resistance test to be described, polyester yarns were used to form the fabric 20 in accordance with this invention. However, other yarns could be used, and particularly, an elastic yarn, such as spandex (rubber) or polyurethane, could be knitted together with another yarn, such as nylon or polyester, to improve further the fabric's stretchability and resiliency.

Figure 8:
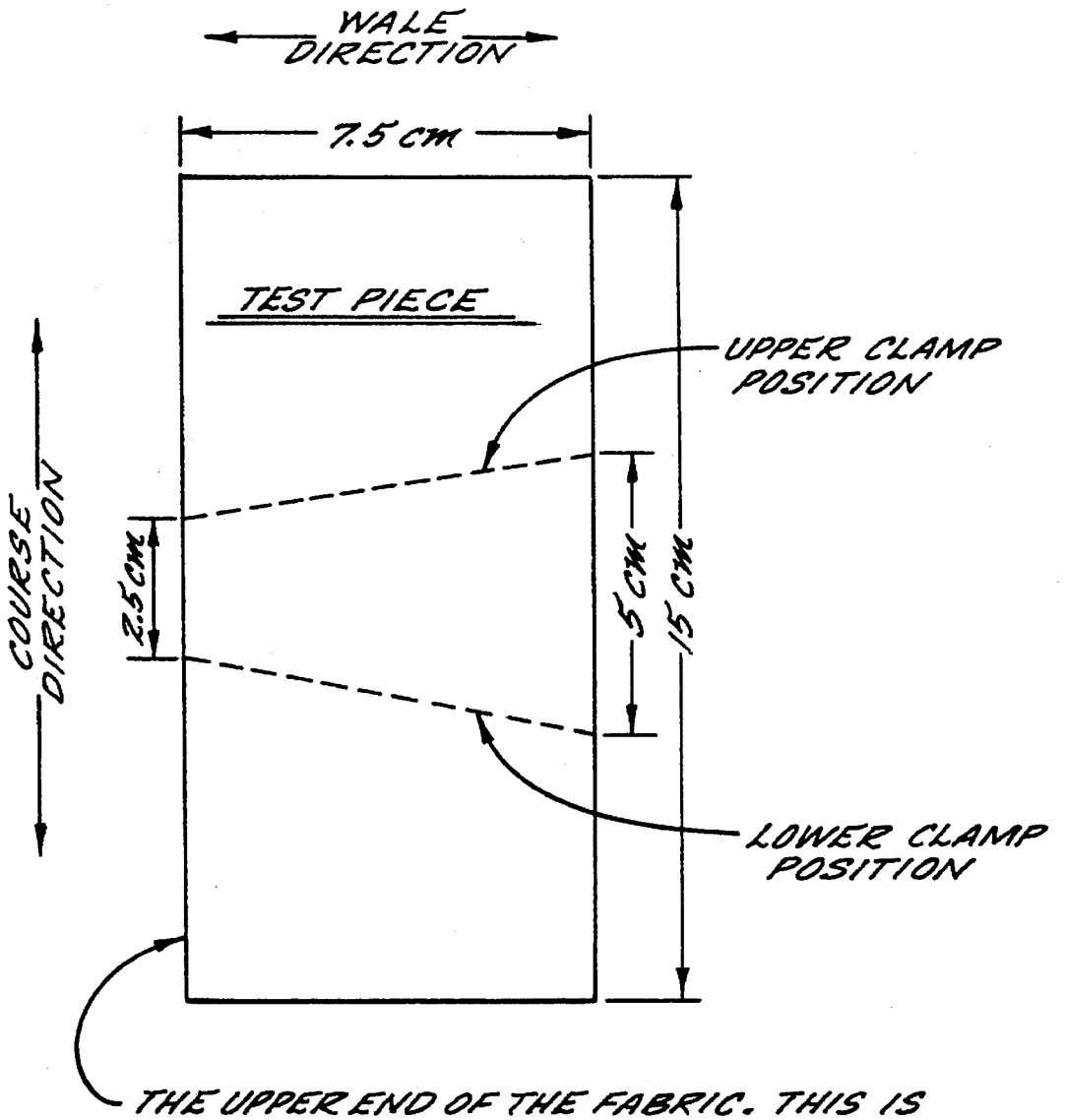
FIG. 8 is a schematic view illustrating a testing method for testing the run resistant characteristics of double-knit fabrics.

The following test was conducted to evaluate the fabric's non-runability. A sample of the fabric produced in accordance with the present invention was prepared (in accordance with Japanese Industrial Standards, JIS L1018) and the yarns were disentangled at the cut-off part, which is on the upper side of the fabric where a run is to be generated and loops were exposed at the cut-off end. A test piece was then made by cutting a sample at 7.5 cm in the wale direction and 15 cm in the course direction. An isosceles-trapezoidal mark was drawn as shown in FIG. 8 and the sample was clamped in a constant-speed stretching tension tester with an automatic recording device. The short side of the isosceles trapezoid of the test sample was clamped with a clamp having a width of at least 7.5 cm by stretching that side at the clamping interval of 2.5 cm while loosely clamping the long side. At this time the upper and lower clamps are parallel. The test was conducted at a constant speed of 2.0 mm/min. and the results were recorded by the automatic recorder.

In the graph recorded by the automatic recorder, if a run does not occur during the tension test, the stretching speed is constant and the tension load in relation to the stretching shows a proportional curve. On the other hand, if a run occurs, the tension load decreases and the graph first shows a vertical drop followed by a saw-tooth wave. This is because when the fabric in which a run has occurred is further stretched, the tension load is no longer stable. By reading the point on the graph where the drop occurred, it is possible to measure how many centimeters the sample had been stretched when the run occurred.

Figure 9A:
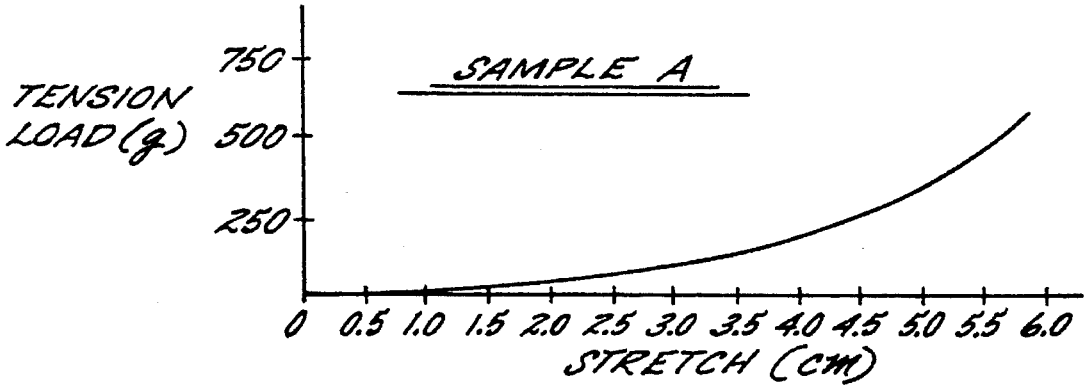
FIGS. 9A–9C are schematic views illustrating graphs of test results of the testing method illustrated in FIG. 8 on different samples of double-knit fabric.
Figure 9B:
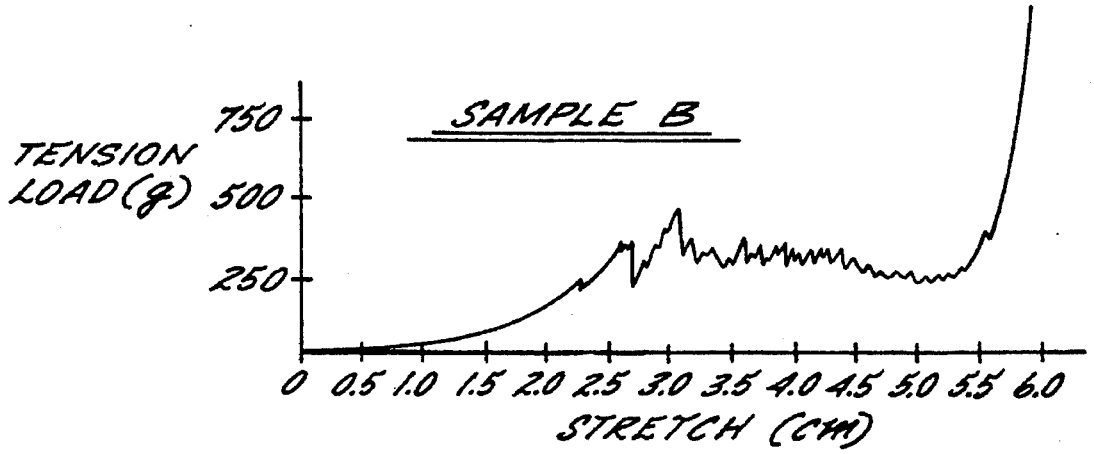
Figure 9C:
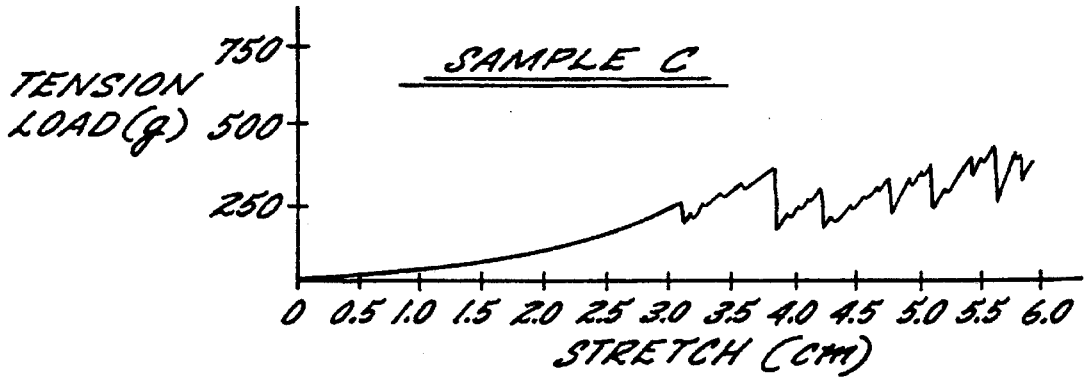
Figure 10A:
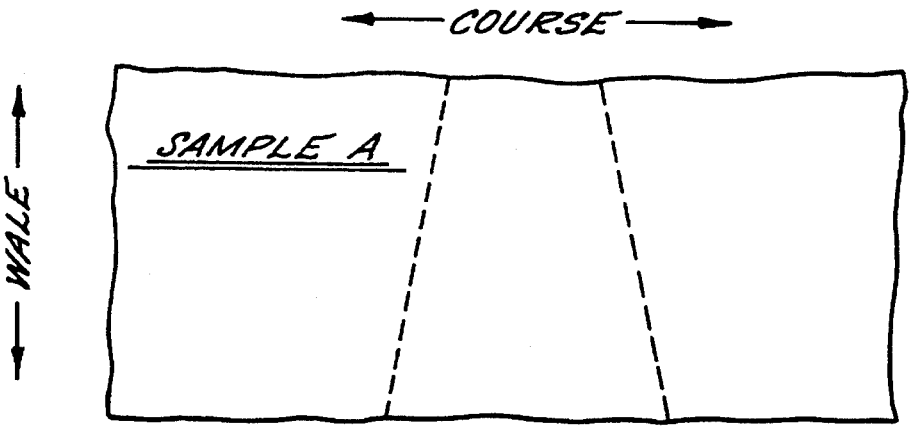
FIGS. 10A–10C are schematic views illustrating the double-knit fabric samples of FIGS. 9A–9C after testing.
Figure 10B:
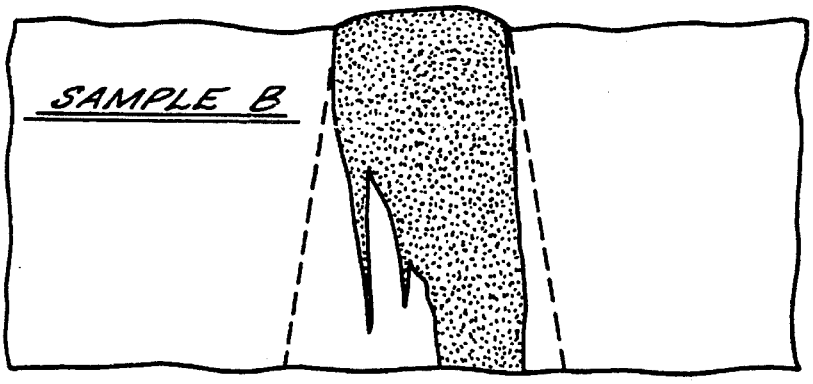
Figure 10C:
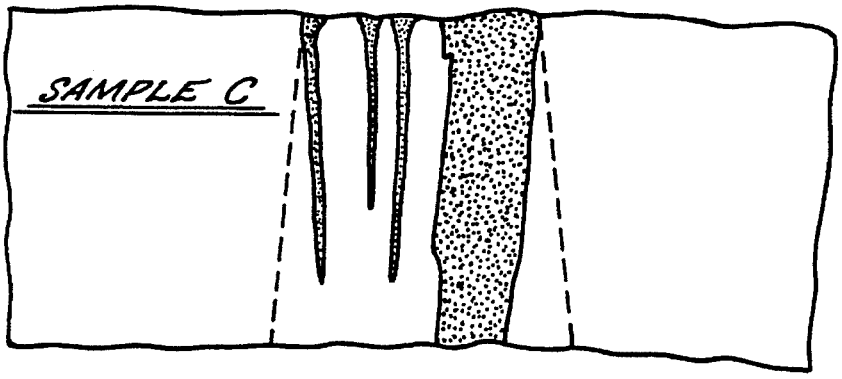

Tests were conducted on three samples A, B and C shown respectively in FIGS. 10A, 10B and 10C. The graphs of the tests on the samples are reproduced in FIGS. 9A, 9B and 9C, respectively. The sample A shown in FIG. 10A is the fabric 20 shown in FIG. 2 knitted from 50 denier, 48 filament polyester yarns. Sample B in FIG. 10B is a conventional royal interlock double-knit fabric produced from the same polyester yarn. Sample C in FIG. 10C is also a conventional interlock double-knit fabric produced from two of the polyester yarns knitted as a pair.

In FIGS. 10B and 10C, the run areas are shaded black for contrast. As can be seen from FIGS. 9A and 10A, no run occurred in sample A of fabric 20 of the present invention. The first run occurred in sample B after only 2.3 cm of stretching. Thereafter, runs occurred all over the short side of the test sample B. The first run in sample C occurred when it was stretched about 3.2 cm. Thereafter, runs occurred intermittently over approximately one-half of the short side of the test sample C. These test results prove that the fabric of the present invention has excellent non-run characteristics.

In the drawings and specifications, there have been set forth preferred embodiments of the invention, and although specific terms are employed, they are used in a generic and descriptive sense only and not for purposes of limitation.

That which is claimed is:

1. A double-knit fabric characterized by non-runability and by coursewise stretchability, said fabric comprising a plurality of yarns knit into stitch loops arranged in wales and courses, each stitch loop in each wale being formed of a first yarn of said plurality of yarns from a stitch loop in a same course in an immediately adjacent wale and a second yarn of said plurality of yarns from a stitch loop in an immediately adjacent course in an immediately adjacent wale.

2. A double-knit fabric characterized by non-runability and by coursewise stretchability, said fabric comprising a plurality of yarns knit into stitch loops arranged in wales and courses defining a wale direction and a course direction, alternating wales in said fabric being cylinder needle wales and intervening wales being dial needle wales, the stitch loops in said cylinder needle wales and the loops in said dial needle wales in each course being off-set from each other in the wale direction, each stitch loop in each wale being formed of a first yarn from a stitch loop in a same course in an immediately adjacent wale and a second yarn from a stitch loop in a different, adjacent course in an immediately adjacent wale.

3. A double-knit fabric according to claim 2 wherein said stitch loops in said cylinder needle wales and said stitch loops in said dial needle wales in each course are off-set in the wale direction by about one-half course.

4. A double-knit fabric according to claim 3 wherein said fabric is a rib-gated fabric with the stitch loops in the cylinder needle wales facing in one direction and the stitch loops in the dial needle wales facing in the opposite direction.

5. A double-knit fabric according to claim 2 wherein one of said first and second yarns is an elastic yarn to provide still further stretchability to said fabric.

6. A double-knit fabric characterized by non-runability and by coursewise stretchability, said fabric comprising a plurality of yarns knit into stitch loops arranged in wales and courses defining a wale direction and a course direction, alternating wales in said fabric being cylinder needle wales and intervening wales being dial needle wales, said stitch loops in said cylinder needle wales being off-set in the wale direction from said stitch loops in said dial needle wales, adjacent dial needle and cylinder needle wales forming pairs of wales, said stitch loops in alternating pairs of dial needle and cylinder needle wales of each course being formed of first and second yarns and said stitch loops in intervening pairs of dial needle and cylinder needle wales being formed of third and fourth yarns, said first and third yarns extending from a stitch loop in the dial needle wale of each pair of wales in each course in the coursewise direction to a stitch loop in the cylinder needle wale of the pair of wales in a same course and said second and fourth yarns extending coursewise from said stitch loop in the dial needle wale of each pair of wales to a stitch loop in the adjacent cylinder needle wale of the pair of wales in an adjacent course, said first and second yarns extending in a coursewise direction from the cylinder needle wale of each alternating pair of wales across an adjacent intervening pair of wales to a stitch loop in the dial needle wale of a next alternating pair of wales in the course that said first yarn formed stitch loops in the first alternating pair of wales, and said third and fourth yarns extending in a coursewise direction from the cylinder needle wale of each intervening pair of wales across an adjacent alternating pair of wales to a stitch loop in the dial needle wale of a next intervening pair of wales in the same course in which said third yarn has formed stitch loops in the preceding intervening pair of wales.

7. A double-knit fabric according to claim 6 wherein said stitch loops in said dial needle wales and said stitch loops in said cylinder needle wales are off-set in the wale direction by about one-half course.

8. A double-knit fabric according to claim 7 wherein said fabric is a rib-gated fabric with the stitch loops in the dial needle wales facing in one direction and the stitch loops in the cylinder needle wales facing in the opposite direction.

9. A double-knit fabric according to claim 6 wherein said first and third yarns are elastic yarns to provide still further stretchability to said fabric.

10. A method of knitting a double-knit fabric on an interlock circular knitting machine having two types of cylinder needles arranged alternately on a cylinder and two types of dial needles arranged alternately on a dial, said method comprising controlling the cylinder and dial needles in a first process in which one type of the cylinder needles is moved successively to and from a cylinder needle high-tucking position, a cylinder needle holding position and a cylinder needle clearing position while maintaining the other type of the cylinder needles in a cylinder needle welt position and in which one type of the dial needles is moved to and from a dial needle clearing position and a dial needle high-tucking position, while maintaining the other type of the dial needles in a dial needle holding position, controlling the cylinder and dial needles in a second process in which the other type of the cylinder needles is moved to and from the cylinder needle high-tucking position, holding position and clearing position while maintaining the one type of the cylinder needles in the cylinder needle welt position, and in which the other type of the dial needles is moved to and from the dial needle clearing position and the dial needle high-tucking position while maintaining the one type of the dial needles in the dial needle holding position, and while feeding at least one yarn to the cylinder and dial needles during the first and second processes whereby stitch loops are formed of two yarns in each wale and stitch loops in each course in adjacent wales are formed of one yarn from that course in the adjacent wale and another yarn from an adjacent course in the adjacent wale.

11. A double-knit fabric characterized by non-runability and by coursewise stretchability, said fabric comprising a plurality of yarns knit into stitch loops arranged in wales and courses, said wales being arranged in alternating and intervening pairs of wales, each stitch loop in each wale of said alternating pairs of wales being formed of a first yarn of said plurality of yarns from a stitch loop in a same course in another wale of said alternating pairs of wales and a second yarn of said plurality of yarns from a stitch loop in an adjacent course in another wale of said alternating pairs of wales, and each stitch loop in each wale of said intervening pairs of wales being formed of a third yarn of said plurality of yarns from a stitch loop in the same course in another wale of said intervening pairs of wales and a fourth yarn of said plurality of yarns from a stitch loop in an adjacent course in another wale of said intervening pairs of wales.

12. A double-knit fabric according to claim 11 wherein said first and second yarns extend coursewise of said fabric between alternating pairs of wales across said intervening pair of wales without being knit in said intervening pair of wales and said third and fourth yarns extend across said alternating pair of wales between intervening pairs of wales without being knit in said alternating pair of wales.

13. A double-knit fabric according to claim 12 wherein said first and second yarns extend across said intervening pair of wales in front on the stitch loop in one of the wales of said intervening pair of wales and behind the stitch loop in the other wale of said intervening pair of wales, and said third and fourth yarns extend across said alternating pair of wales in front of the stitch loop in one wale and behind the stitch loop in the other wale of said alternating pair of wales.

* * * * *

UNITED STATES PATENT AND TRADEMARK OFFICE

CERTIFICATE OF CORRECTION

PATENT NO. : 5,463,881

DATED : November 7, 1995

INVENTOR(S) : Igarashi et al.

It is certified that error appears in the above-identified patent and that said Letters Patent is hereby corrected as shown below:

On the cover page at Section [56] References Cited, U.S. PATENT DOCUMENTS, "2,379,649 9/1937 Nebel" should be -- 2,379,649 7/1945 Nebel --;

On the cover page at Section [56] References Cited, FOREIGN PATENT DOCUMENTS, "186767 10/1956 Germany" should be -- 186767 9/1956 Germany --; and Column 3, line 24, after "loops" insert -- 31, --.

Signed and Sealed this

Twenty-sixth Day of March, 1996

Bruce Lehman

*Attest:*

BRUCE LEHMAN

*Attesting Officer*

*Commissioner of Patents and Trademarks*